United States Patent [19]

Zanco

[11] Patent Number: 4,922,635

[45] Date of Patent: May 8, 1990

[54] SKI BOOT WITH AUTOMATIC CLOSURE

[75] Inventor: Alain L. Zanco, Voiron, France

[73] Assignee: Skis Rossignol S.A., Switzerland

[21] Appl. No.: 365,654

[22] Filed: Jun. 13, 1989

[30] Foreign Application Priority Data

Jun. 17, 1988 [FR] France ..... 88 08169

[51] Int. Cl.[5] ..... A43B 5/04

[52] U.S. Cl. ..... 36/120; 361/117; 361/118; 361/119

[58] Field of Search ..... 36/115, 117, 118, 119, 36/120, 121

[56] References Cited

U.S. PATENT DOCUMENTS 4,551,933 11/1985 Morell et al. ..... 36/120
4,735,004 4/1988 Dodge ..... 36/121 X
4,759,137 7/1988 Lederer ..... 36/117

*Primary Examiner*—Paul T. Sewell
*Assistant Examiner*—Andrew D. Meyers
*Attorney, Agent, or Firm*—Kane, Dalsimer, Sullivan, Kurucz, Levy, Eisele and Richard

[57] ABSTRACT

A ski boot composed of a rigid sole (1), on the front of which a shell in the form of a shoe (2) is articulated, and of an upper composed of a front part (4) fixed to the shell and of a rear part (6) articulated at the rear of the sole. The rear part (6) is connected to the shell by means of two pivots (15, 16), each interacting with a slot comprising at least two segments (17*a* and 17*b*). The first segment (17*a*) is in the form of an arc of a circle centered approximately on the axis of articulation (7) of the rear part of the upper. The boot closes automatically as a result of the pressure of the foot and likewise opens automatically and widely during the forward bending of the leg accompanied by the lifting of the heel.

6 Claims, 5 Drawing Sheets

Fig. 3
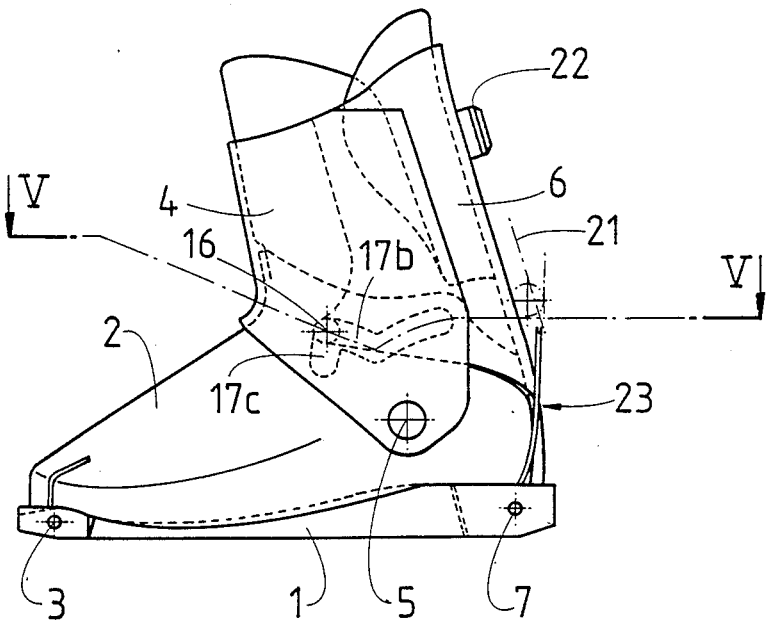
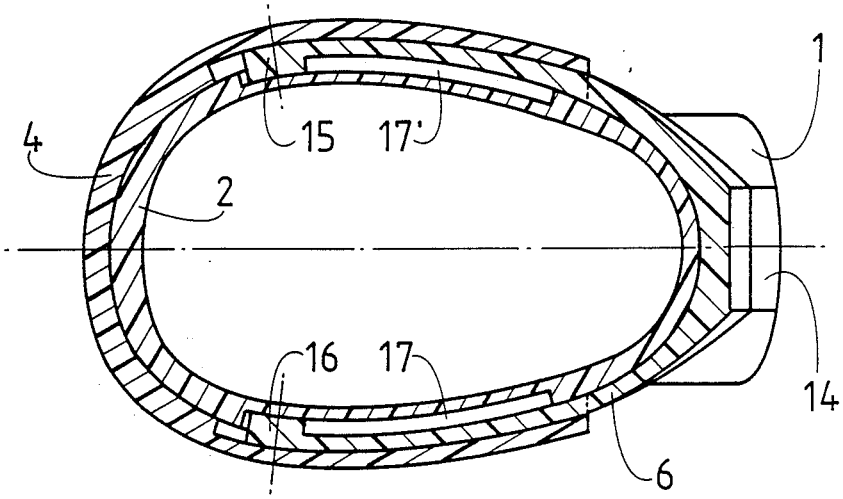
Fig. 5

SKI BOOT WITH AUTOMATIC CLOSURE

FIELD OF THE INVENTION

The present invention relates to a ski boot composed of a rigid sole, on the front of which a shell in the form of a shoe is articulated, and of an upper composed of a front part fixed to the shell and of a rear part articulated at the rear of the sole, the said shell and the rear part of the upper being connected to one another by connecting means ensuring the automatic closing and tightening of the upper as a result of the pressure of the foot when the boot is being put on.

PRIOR ART

Such a boot was proposed in the patent application FR 2,450,574. In this boot, connecting means between the shell articulated at the front and the part of the upper articulated at the rear are composed of a cable, the ends of which are attached on each side of the rear part of the upper and which passes over the instep, at the same time forming a loop round the rear part of the upper. These connecting means do not allow the boot to open wide, but on the contrary it seems that the effect of the forward tilting of the shell is to carry the articulated part of the upper forwards, thus closing the boot, instead of opening it.

Moreover, the document JP 57-86301 makes known a boot to be put on at the rear, which is composed of a shell produced in one piece with the sole and in which an articulated insole ensures the closing of the rear half-upper by means of a relatively heavy and complicated transmission mechanism which works only with a closing effect.

Starting from the construction proposed in the application FR 2,450,574, the object of the present invention is, by simple means, to provide a boot with automatic closing and opening, ensuring a wide opening of the boot, in order to make it especially easy to put on.

SUMMARY OF THE INVENTION

The boot according to the invention is defined in that the rear part of the upper is connected to the shell by means of two pivots, each interacting with a slot located in the shell and provided on each side of the latter.

The interaction of a pivot and a slot makes it possible perfectly to control the kinematics involved in closing and opening the boot.

In fact, according to a preferred embodiment of the invention, the said slots have, starting from the rear, a first part in the form of an arc of a circle centered approximately on the axis of articulation of the rear part of the upper, followed by a second part rising obliquely forwards, the first part of the slot allowing the rear part of the upper to tilt rearwards when the shell is moved away from the sole as a result of a forward rotation, the effect of pressure of the sole of the foot and of the heel, in the open position, being to return the rear part of the upper forwards in a first step and then to close the upper in a second step, a bending of the leg accompanied by a lifting of the heel having the opposite effect of opening the boot wide.

The front part of the upper could be produced in one piece with the shell, but according to one embodiment of the invention the front part of the upper is likewise articulated on the shell and the second part of the slot is followed by a falling third part allowing the two parts of the upper to pivot forwards simultaneously when the upper experiences bending during skiing. Elastic elements can be mounted in the three parts of the slots, in order to control the bending elasticity of the upper.

BRIEF DESCRIPTION OF THE DRAWINGS

The accompanying drawing illustrates an embodiment of the invention by way of example.

FIG. 3 shows the boot in the closed position.

FIG. 5 is a partial top view in section along the line V—V of FIG. 3.

DESCRIPTION OF THE PREFERRED EMBODIMENT

Figure 4:
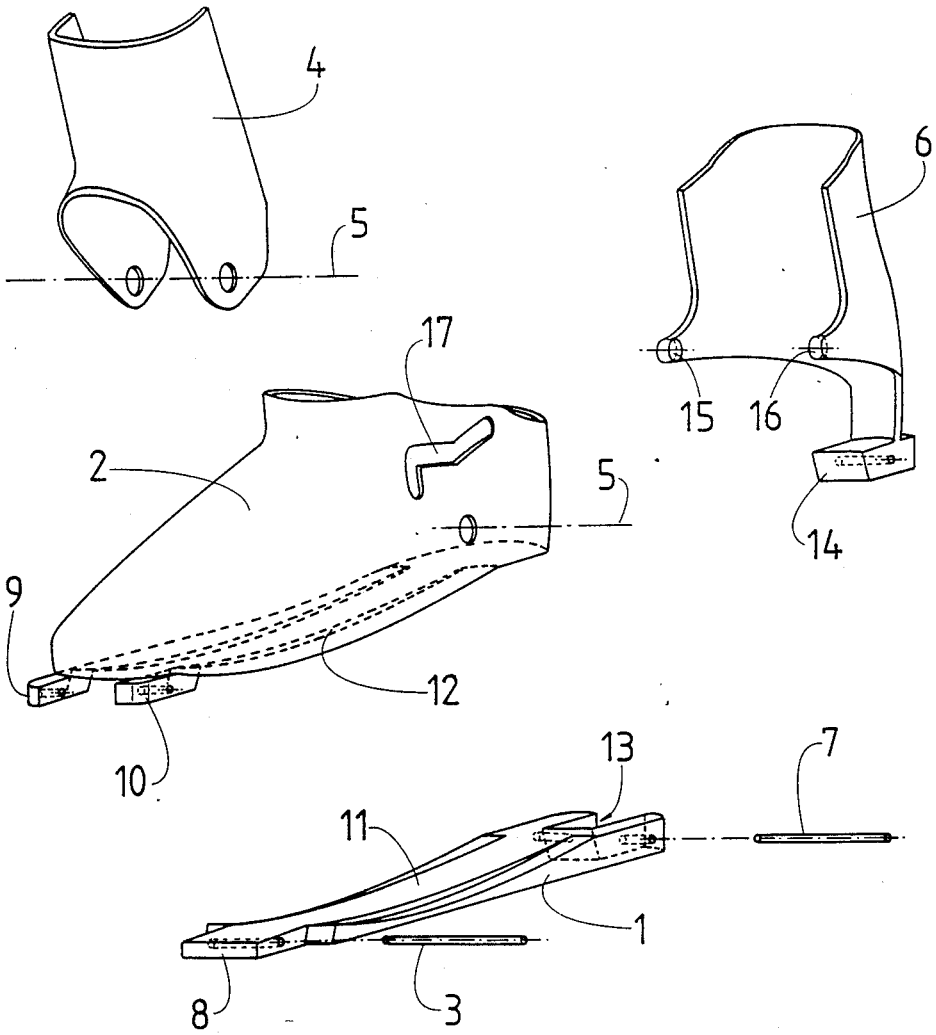
FIG. 4 is an exploded view of the component parts of the boot.

The boot illustrated is composed of a rigid sole 1, of a shell 2 in the form of a shoe, articulated on the front of the sole 1 about an axle 3, of a front half-upper 4 articulated on the shell 2 by means of two rivets 5 in a way known per se, and of a rear half-upper 6 articulated at the rear of the sole about an axle 7. The front end 8 of the sole 1 has a narrowed portion, on which the shell 2 is articulated by means of two tenons 9 and 10 (FIG. 4).

The top of the sole 1 is shaped so as to have a rectangular central projection 11 which engages into a depression of corresponding form 12 of the shell 2, thus ensuring an actual interlocking of the shell 2 with the sole 1 in the closed position of the boot and consequently the lateral retention of the shell 2 on the sole 1. At the rear, the sole 1 has a rectangular cut-out 13, in which comes to rest the heel 14 of the rear half-upper 6, through which the axle 7 passes. The rear half-upper 6 is equipped with two pivots 15 and 16, each interacting with a slot 17, 17' (FIG. 5) made in the shell 2 on each side of the latter. The slot 17, 17' has, starting from the rear of the shell 2, a first segment **17*a* in the form of an arc of a circle, the center of which coincides with the axle 7, a second segment 17*b* rising slightly towards the front of the boot and forming an elbow or deflection point relative to the first segment 17*a*, and a short, substantially vertical falling third segment 17*c*. The segment 17*b* has a slight curvature, the center of which is located underneath the sole 1. The third segment 17*c* can likewise have a slight curvature, the center of which is located at the rear of the boot. As regards the first segment 17*a*, the form of an arc of a circle centered on the axle 7 is not a condition which must be adhered to strictly, since the rear half-upper 6 has some flexibility and, on the other hand, the shell 2 can descent to a greater or lesser extent between the position shown in FIG. 1 and that shown in FIG. 2, so that the curvature of the segment 17*a*** could be greater than the curvature illustrated.

The boot is equipped, is the conventional way, with an inner sock 18 completed by a lining 19 of the rear half-upper 6. The boot also possesses inner means for the gripping of the foot, of which a cable 20 and, by its direction 21, a tensioning lever mounted at the rear of the boot are shown. Furthermore, the two parts 4 and 6 of the upper are kept closed by means of a buckle 22 which can be a conventional buckle.

The functioning of the boot will now be described with reference to FIGS. 1 to 3.

Figure 1:
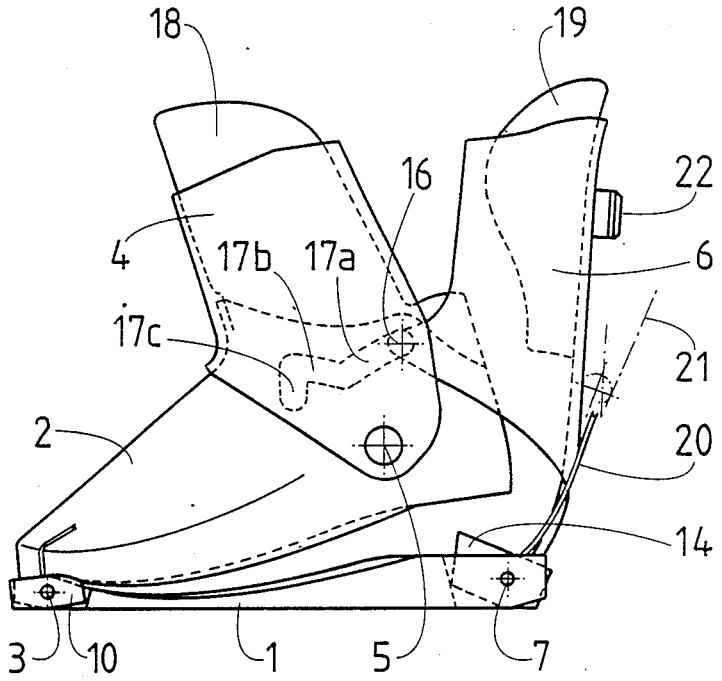
FIG. 1 shows the boot in the completely open position.
Figure 2:
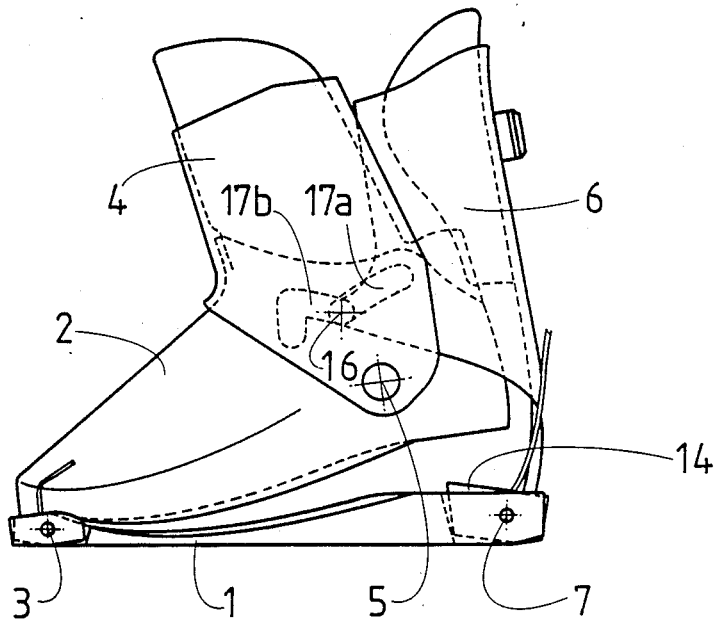
FIG. 2 shows the boot in an intermediate position.

In the position shown in FIG. 1, the shell 2 is moved away from the sole and the rear half-upper 6 is tilted rearwards, the pivots 15 and 16 being up against the ends of slots 17 and 17'. In this position, the boot is wide open both at the front and at the rear, and it is especially easy to insert the foot into the boot. The effect of inserting the foot into the shell 2 and of the pressure of the sole of the foot and of the heel on the bottom of this shell 2 is, in a first step, to cause the shell 2 to descend very slightly, thereby driving the pivots 15 and 16 via the first slot segments 17*a*. An intermediate position shown in FIG. 2 is thus assumed at the deflection point of the slot 17. From the position shown in FIG. 1 to the position shown in FIG. 2, the shell bottom descends only approximately 2°. Consequently, the segment 17*a* is in the form of an arc of a circle virtually centered on the axle 7.

When the shell 2 continues its descent, the pivots 15 and 16 enter segment 17*b* of the slots, the effect of which is to drive the rear half-upper 6 further towards the front of the boot. The heel of the shell 2 contributes to this movement by coming to bear on the heel 14 of the rear half-upper 6 which functions as a pedal. FIG. 3 shows the boot completely closed, the pivot 16 being at the limit of its travel at the end of the segment 17*b* of the slot 17. The buckle 22 is then closed round the upper and the foot can be gripped inside the shell by means of the tension 21. The third segment 17*c* of the slot 17 allows the upper to bend forwards during skiing. The front half-upper 4 pivots about its joint 5, whilst the rear half-upper 6 bends approximately about a point 23. These two pivot points determine the form of the segment 17*c* of the slot. That part of the segment 17*c* located underneath the segment 17*b* contains an elastic element, for exmaple a piece of rubber, ensuring the bending elasticity of the upper during skiing. However, it would be possible to omit the segment 17*c*, bending then being ensured as a result of the inherent elasticity of the boot.

The form of the segments 17*a* and 17*b* of the slots is goverened by the kinematics of the closing movement of the boot. This form could be different from the form shown.

The closing movement is reversible. This means that the skier, after releasing his foot and opening the buckle 22, can take off the boot simply by lifting his heel. This causes a change from the position shown in FIG. 3 to the position shown in FIG. 1. The rear half-upper 6 is forced to pivot about its axle 7 and thus tilt rearwards, ensuring that the boot opens wide.

The principle of automatic closing and opening proposed by the invention can also be applied to a boot of which the front half-upper 4 is produced in one piece with the shell 2.

Figure 6:
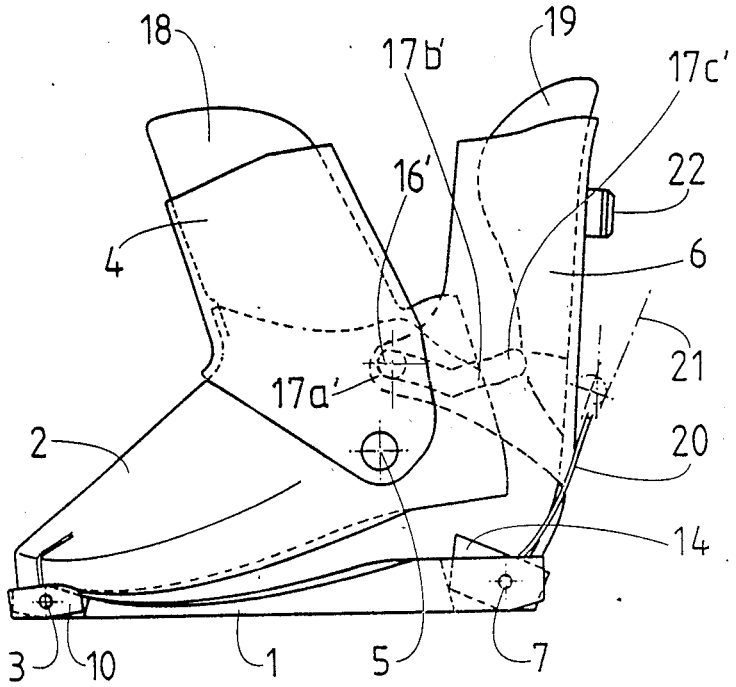
FIGS. 6–8 corresponding to FIGS. 1–3, show a boot of this invention possessing kinematic inversion.
Figure 7:
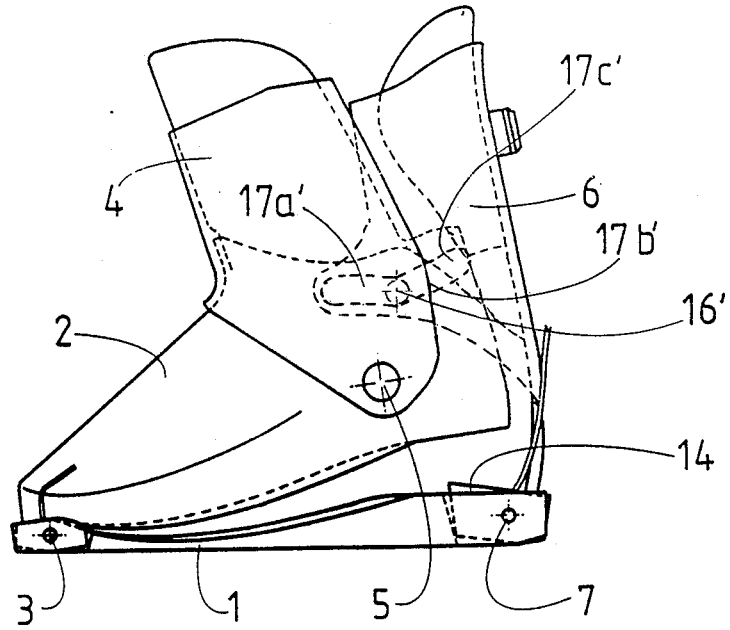
Figure 8:
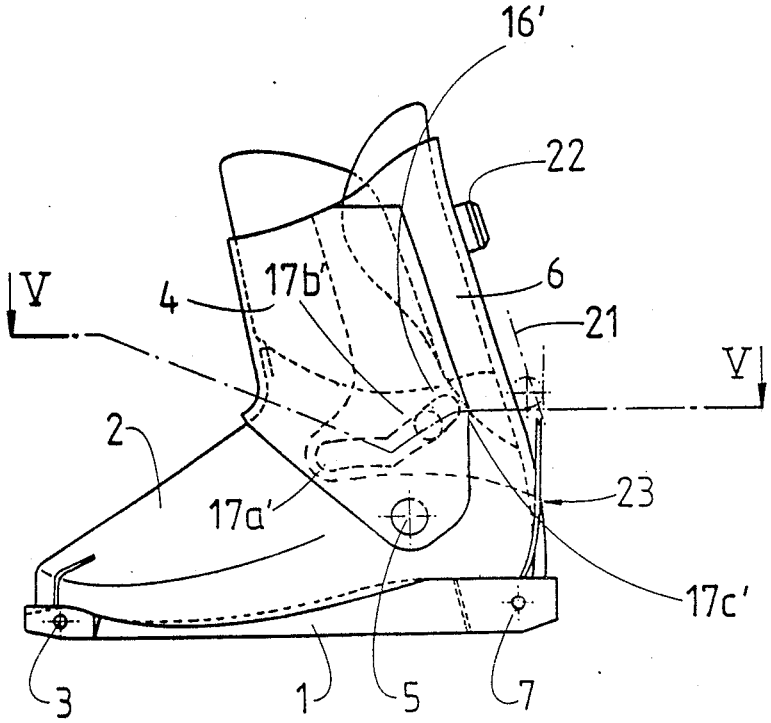

Like most kinematic connections, this one could be inverted as shown in FIGS. 6, 7, and 8, the slots being provided on the rear half-upper 6 and the pivots on the shell 2. In this case, the part 17*a*' of the slot is located towards the front of the boot. It is followed, in the rearward direction of the boot, by the part 17*b*' and the part corresponding to the part 17*c*', in this case directed upwards.

I claim:

1. A ski boot composed of a rigid sole (1), on the front of which a shell in the form of a shoe (2) is articulated, and of an upper composed of a front part (4) fixed to the shell and of a rear part (6) articulated at the rear of the sole, the said shell and the rear part of the upper being connected to one another by connecting means (15, 16, 17) ensuring the automatic closing and tightening of the upper as a result of the pressure of the foot when the boot is being put on, wherein the rear part of the upper (6) is connected to the shell by means of two pivots (15, 16), each interacting with a slot (17, 17') located in the shell and provided on each side of the latter, these slots having, starting from the rear, a first part in the form of an arc of a circle (17*a*) centered approximately on the axis of articulation (7) of the rear part of the upper, followed by a second part (17*b*) rising obliquely forwards, the first part of the slot (17*a*) allowing the rear part of the upper (6) to tilt rearwards when the shell is moved away from the sole as a result of a forward rotation, the effect of pressure of the sole of the foot and of the heel, in the open position, being to return the rear part of the upper forwards in a first step and then to close the upper in a second step, a bending of the leg accompanied by a lifting of the heel having the opposite effect of opening the boot wide.

2. A boot as claimed in claim 1, wherein the front part of the upper (4) is articulated on the shell, and wherein the said slots have, after the second part (17*b*), a falling third part (17*c*) allowing the two parts of the upper to pivot simultaneously forwards during the bending of the upper.

3. A boot as claimed in claim 2, wherein the said third part (17*c*) of the slots contains an elastic element working under compression.

4. A ski boot composed of a rigid sole, on the front of which a shell in the form of a shoe is articulated, and of an upper composed of a front part fixed to the shell and of a rear part articulated at the rear of the sole, the said shell and the rear part of the upper being connected to one another by connecting means ensuring the automatic closing and tightening of the upper as a result of the pressure of the foot when the boot is being put on, wherein the rear part of the upper is connected to the shell by means of two slots, each interacting with a pivot of the shell provided on each side of the latter, these slots having, starting at the front, a first part in the form of an arc of a circle centered approximately on the axis of articulation of the rear part of the upper, followed by a second part rising obliquely rearwards, the first part of the slot allowing the rear part of the upper (6) to tilt rearwards when the shell is moved away from the sole as a result of a forward rotation, the effect of pressure of the sole of the foot and of the heel, in the open position, being to return the rear part of the upper forwards in a first step and then to close the upper in a second step, a bending of the leg accompanied by a lifting of the heel having the opposite effect of opening the boot wide.

5. A boot as claimed in claim 4, wherein the front part of the upper is articulated on the shell, and wherein the said slots have, after the second part, a rising third part allowing the two parts of the upper to pivot simultaneously forwards during the bending of the upper.

6. A boot as claimed in claim 5, wherein the said third part of the slots contains an elastic element working under compression.

* * * * *

UNITED STATES PATENT AND TRADEMARK OFFICE

CERTIFICATE OF CORRECTION

PATENT NO. : 4,922,635

DATED : May 8, 1990

INVENTOR(S) : Alain L. Zanco

It is certified that error appears in the above-identified patent and that said Letters Patent is hereby corrected as shown below:

Title Page:
Assignee: --Skis Rossignol S.A., 38500 VOIRON
Le Menon, FRANCE --

Signed and Sealed this

Thirtieth Day of June, 1992

*Attest:*

DOUGLAS B. COMER

*Attesting Officer*

*Acting Commissioner of Patents and Trademarks*